United States Patent [19]

Peters et al.

[11] Patent Number: 4,720,107

[45] Date of Patent: Jan. 19, 1988

[54] MINI-SHAKE, TWIST, AND SLIDE HORSESHOE GAME

[76] Inventors: Duane Peters; Ty C. Peters, both of 2237 Terrace Dr., New Brighton, Minn. 55112

[21] Appl. No.: 820,659

[22] Filed: Jan. 21, 1986

[51] Int. Cl.[4] ..... A63B 67/14; A63B 59/02; A63B 65/00; A63F 7/06

[52] U.S. Cl. ..... 273/109; 273/327; 273/128 R; 273/126 R; 273/427

[58] Field of Search ..... 273/85 E, 424, 425, 273/427, 108, 126, 327, 336, 338, 109

[56] References Cited

U.S. PATENT DOCUMENTS

| | | | |
|---|---|---|---|
| 500,795 | 7/1893 | Bradley | 273/327 |
| 527,522 | 10/1894 | Hitchcock et al. | 273/327 |
| 887,636 | 5/1907 | Henderson | 273/327 |
| 3,149,977 | 5/1962 | Glassman | 273/126 R |

FOREIGN PATENT DOCUMENTS

| | | | |
|---|---|---|---|
| 624 | 10/1931 | Australia | 273/128 R |
| 171912 | 12/1921 | United Kingdom | 273/338 |

*Primary Examiner*—Richard C. Pinkham
*Assistant Examiner*—Gary Jackson

[57] ABSTRACT

Mini horseshoes, and mini stokes concealed in one container adapted for use as a game, toy, puzzle or etc. and can be used in any kind of weather indoors or outdoors, and including a compact light readily assembled device, and provided with a see through cover, and a solid colored base.

The base has several threaded vertical holes therethrough. A stake is threaded into each hole. The stakes extend above the base and serve as targets for mini horseshoes or rings. The lower end of each stake has an enlarged head which is recessed in a rubber foot and anchors that foot to the base. The stakes are colored differently from one another and the horseshoes are correspondingly colored. Surrounding each stake is a colored circular area formed by a decal, or paint applied by a silkscreening process, or a disk or ring recessed into the surface of the base.

8 Claims, 17 Drawing Figures

MINI-SHAKE, TWIST, AND SLIDE HORSESHOE GAME

BACKGROUND OF THE INVENTION

1. Field of the Invention

This invention relates to a mini horseshoe game. The present invention in its preferred form involes a shake and a twist of the wrist to make it operable. The invention is designed to be inclosed so that the mini horeshoes and the stakes will not be touched with human fingers, so the person handling the unit will not soil his hands and possibly his clothes, like the large metal stakes and shoes that are 40 feet apart, for outdoor use.

2. Description of the Prior Art

Metal horeshoes, rubber horseshoes and like devices are commonly used for enjoyment, either indoors or outdoors; for example, the metal ones are thrown outdoors, and the rubber and plastic ones are thrown indoors.

Due to injury and safety concerns, particularly when their are children present, there's always that chance of getting hit by a horseshoe when pitched, thrown, slid or the like.

SUMMARY OF THE INVENTION

The present invention provides a see through cover, for observing the mini horseshoes and the small fasteners, which the top portion of the fasteners provide the small stakes. A nice small case is provided to fit in one hand, and by repositioning it in all kinds of various directions, by the application of a little patience, and the right shake and twist in the right direction it can be a success.

According to the present invention there is provided a device useful for a lot of enjoyment, comprising four mini horseshoes, and four fasteners which make up the four mini stakes. Also one mounts the hanger for the device, incase someone wants to hang the unit up on the wall or the like, when not in use. The four stakes or fasteners are inserted up through the bottom of the base, and a portion of the four fasteners are threaded, and the base has four tapped holes for that purpose.

The device includes means for enclosing the horseshoes and stakes, the cover being a see through cover.

A primary object of the invention is to provide players to stay in one location and the need for walking from one stake to another is eliminated by the mini horseshoes. Fasteners that make up the small stakes are concealed in a small see through container. The cover is secured to the base with three fasteners and the base has three tapped holes for that purpose and means to allow a complete rotation of the stakes and container, at which the mini horseshoes with their provided gaps can pass over or around the stakes. The see through cover and base positioned upside down will enable the mini horseshoes to be free from all stakes.

Accordingly, the present invention provides for a gap through the mini horseshoes to enable the stakes to be rotated with respect such that the mini horseshoes are caused to fall down on the stakes, or slip around the stakes.

The primary object of the invention is to provide an educational toy or puzzle for children from approximately 3 to 6 years old. It will enable them to learn their colors by installing the same colored mini horseshoes around the same colored stake.

A further object of the invention is that from approximately 6 years old to all ages can play the mini horseshoes game. For example four or more players sitting around a table, counter, or in a car or truck, can shake the device and set it on the table, counter, or dash of a vehicle and see how many ringers can be made. To obtain a score a player gets 3 points for a ringer that is if the mini horseshoe is the same color as the stake, but if the mini horseshoe is on a different colored stake, it is only good for 2 points, and 1 point if the mini horseshoe is in the same colored ring, or touching the same colored ring, also 1 point if the shoe is a leaner or hanger on the same colored stake. If the mini horseshoe and stake are not the same color it does not count anything. There are three shakes per turn and the first player to reach 21 points wins the game.

A still further object of the invention is that it is a nice game that can be played rain or shine, indoors or outdoors.

A still further object of the invention is that it is small and compact, and that everyone should have one or two in their glove compartment of each motor vehicle, as it would be a good pastime for everyone when taking a short or long trip with a vehicle, also one in each desk drawer at work.

Further objects ot the invention will presently appear as the description proceeds in connection with the appended claims and the annexed drawings in which,

BRIEF DESCRIPTION OF THE DRAWINGS

Numeral references are used to designate like parts throughout the various figures of the drawings.

DESCRIPTION OF THE PREFERRED EMBODIMENTS

Figure 1:
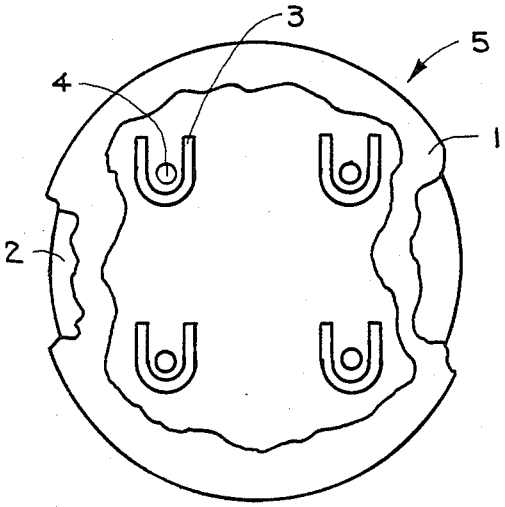
FIG. 1 is a top plan view of the mini horseshoe game with parts broken away to more clearly illustrate the details of construction.

As shown in FIG. 1, in a preferred embodiment, the horseshoe game 5 of the present invention comprises a see through cover 1 which is mounted on top of the base 2. The base 2 includes screws 4, which the base has four tapped holes; those screws are used for more than one purpose, they mount the rubber feet onto the bottom of the base 2, to allow for shock and vibration, and the screws are also used for the stakes, that is the upper portion of them.

Figure 2:
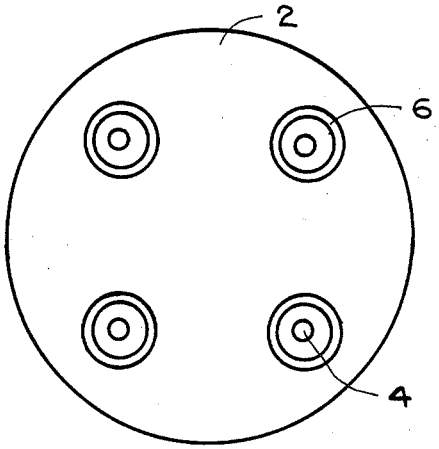
FIG. 2 is a top plan view of the mini horseshoe game with the see through cover removed for clarity and showing rings around each stake.

As shown in FIG. 2, a preferred embodiment, the present invention comprises four different colored rings 6 attached to base 2, or mounted in grooves by means of adhesive, and also flush with base 2.

The base 2 is constructed and preferably is formed of plastic approximately 5/16 inch thick, and white in color, or could be made of wood or other material, and approximately 2¾ inches in diameter, or could be hexagon, triangle, square or some other shape.

The screws are to be made out of nylon and made of four different colors, to be used as fasteners and stakes, and also mount the rubber feet 9, and in one incident it mounts a hanger 13.

The cover 1 is constructed and preferably is formed of clear plastic with a wall thickness of approximately ⅛ inch, height of approximately 2½ inches, and a diameter of approximately 2¾ inches. The cover could be hexagon, triangle, square or some other shape, as shown in FIG. 1, and in further detail in FIGS. 3, and 9.

As shown in FIG. 1, the combination of four fasteners 4, and stakes 4, are formed out of nylon, or some other material like aluminum, steel, etc. The fasteners 4 mount the rubber feet to the base 2, and in one case it also mounts the hanger 13, in case someone wants to hang the unit on the wall. They extend up above the base 2 approximately ¼ inch for the purpose of the stakes 4, and in further detail in FIGS. 2, 4, 5, 6, 7, 8, 10, 11, 12, 13, 14, 15, 16, and 17.

Figure 3:
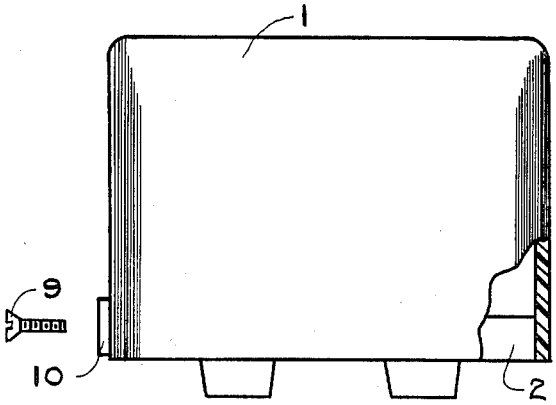
FIG. 3 is a front elevational view thereof; to illustrate the screw and washer for mounting the cover onto the base, also shows rubber feet.

As shown in FIG. 3 in a preferred embodiment the cover is secured to base 2 with 3 fasteners 9 formed out of nylon, and also 3 finish washers 10 formed out of nylon or some other material. Also cover 1 could be secured to base 2 with some kind of adhesive.

Figure 4:
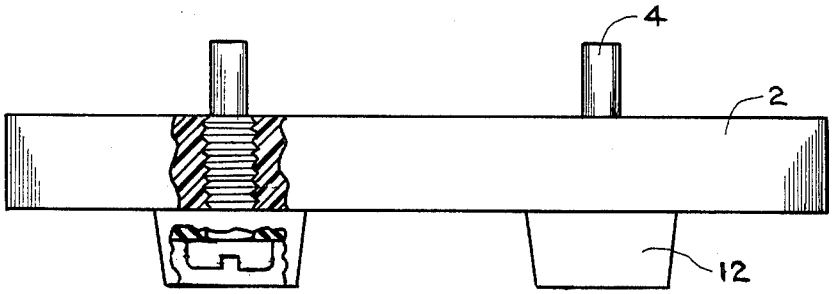
FIG. 4 is a front elevational view with the cover removed for clarity.

Referring to FIG. 4 comprises a base 2 having stakes 4 extending perpendicular to the base 2, rubber feet 12, attached to bottom of base 2 with fasteners 4.

Figure 5:
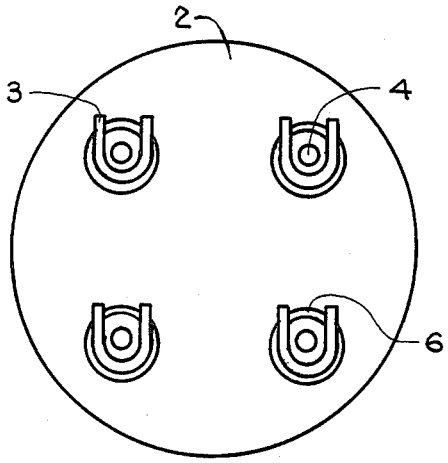
FIG. 5 is a top plan view of the base with the cover removed to more clearly illustrate the 4 shoes positioned around the stakes.

Referring to FIG. 5 comprises a base 2 having stakes 4 and horseshoes 3 located in their respective position around the stakes 4, and rings 6 are in their respective position around the stakes 4.

Figure 6:
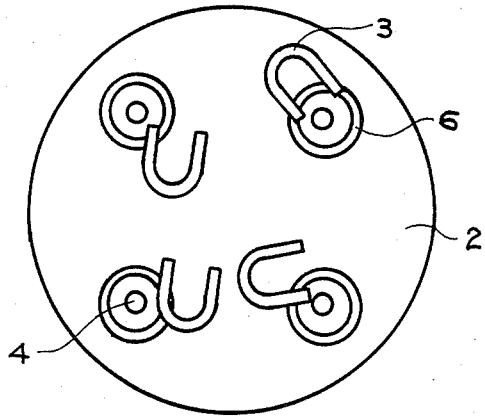
FIG. 6 is a top plan view of the base with the cover removed to more clearly illustrate the four horseshoes touching the rings.

Referring to FIG. 6 is similar to FIG. 5 only the horseshoes 3 are laying in different locations.

Figure 7:
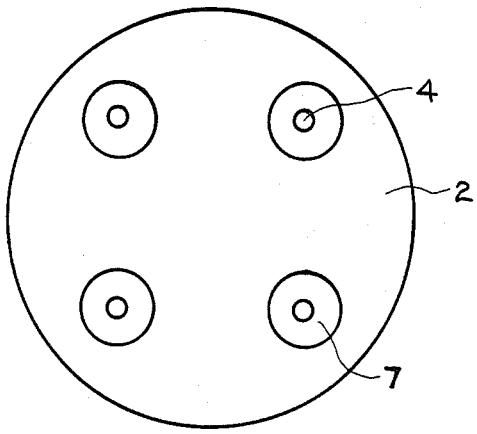
FIG. 7 is a top plan view with the cover, and shoes removed for clarity and showing four different colors by silkscreening.

Referring to FIG. 7 is showing the stakes 4 in their respective locations. There may also be disk designs in four different colors 7 by silkscreening approximately ½ inch in diameter. The colors may be red, blue, green, and brown and they extend a tad above the base 2 surface.

Figure 8:
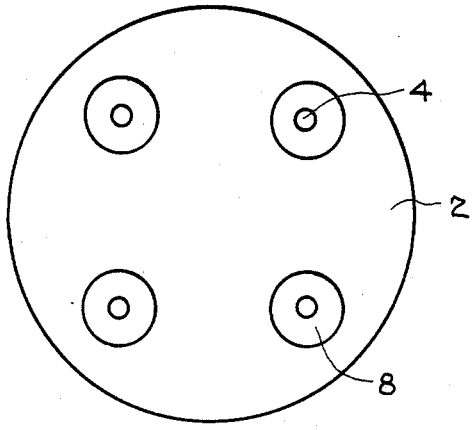
FIG. 8 is a top plan view with the cover, and shoes removed for clarity and showing four different colors of decals.

Referring to FIG. 8 is showing four different colored decals 8, approximately ½ inch in diameter. Colors like red, blue, green, and brown may be used and they are mounted with their own adhesive backing, and extend a tad above the base 2 surface.

Figure 9:
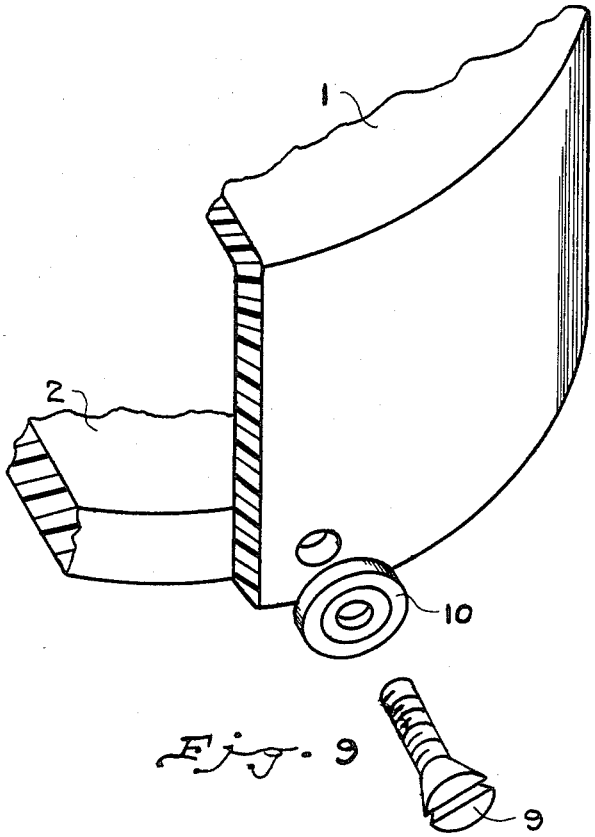
FIG. 9 is a perspective view thereof; showing screw and finish washer mounting cover onto base.

Referring to FIG. 9 is illustrating how the cover 1 is secured to base 2.

Figure 10:
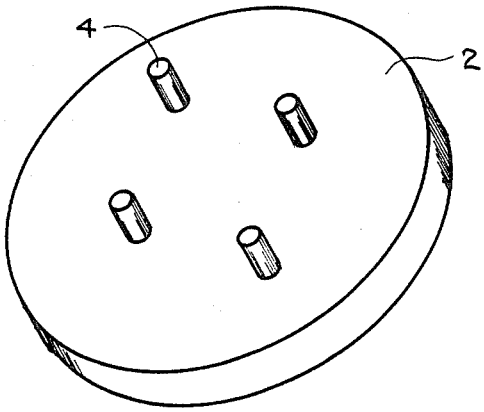
FIG. 10 is a perspective view of the horseshoe game with the cover removed to more clearly illustrate the stakes.

Referring to FIG. 10 is illustrating how the stakes 4 extend above the base 2.

Figure 11:
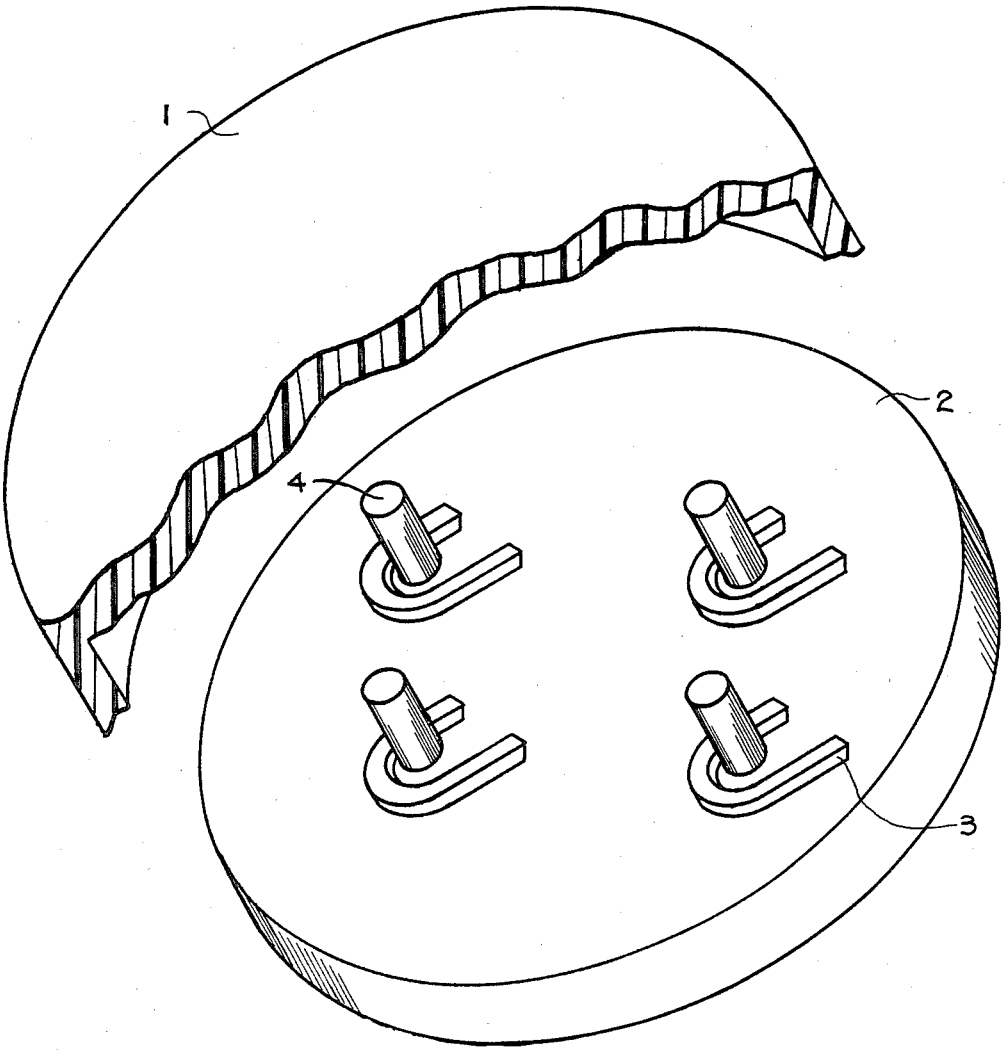
FIG. 11 is a perspective view of the horseshoe game with partial cover shown, to more clearly illustrate the stakes with the mini horseshoes positioned around the stakes.

Referring to FIG. 11 is illustrating how the horseshoes 3 fit around the stakes 4 in a perspective view.

Figure 12:
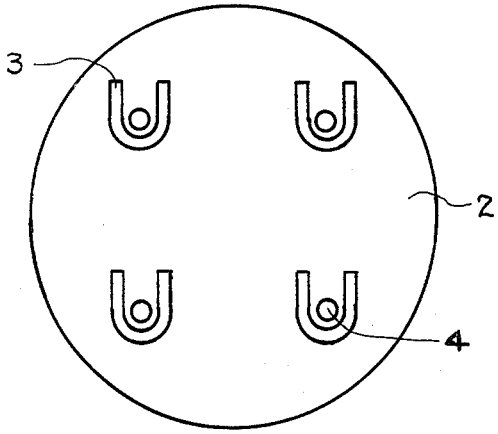
FIG. 12 is a top plan view with the cover removed for clarity, and showing the horseshoes positioned around the stakes.

Referring to FIG. 12 is illustrating how the horseshoes 3 fit around the stakes 4.

Figure 13:
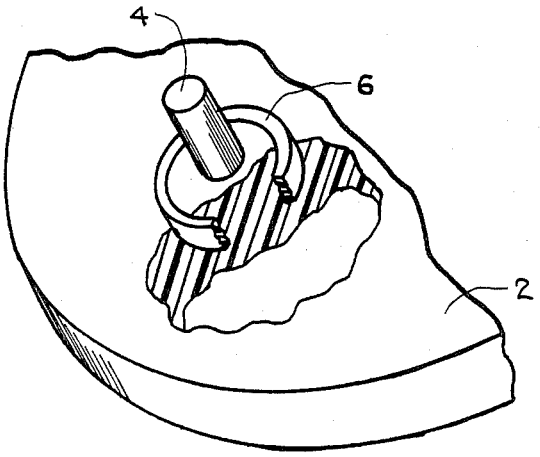
FIG. 13 is a partial perspective view of the horseshoe game showing a ring mounted around a stake.

Referring to FIG. 13 the base 2, comprises a groove for adapting ring 6 and is mounted in place with a little adhesive, and does not extend above the base 2 surface.

Figure 14:
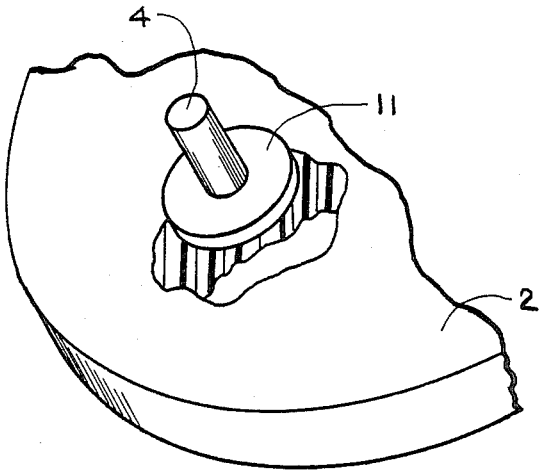
FIG. 14 is a partial perspective view of the horseshoe game showing a disk mounted around a stake.

Referring to FIG. 14 the base 2, comprises a detent, or recess for adapting disk 11, and is mounted flush with base 2, with a little adhesive.

Figure 15:
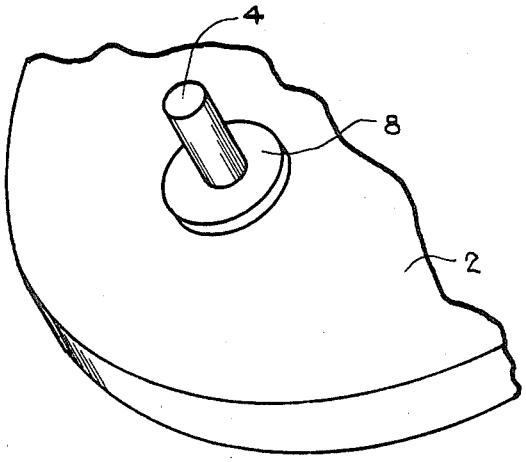
FIG. 15 is a partial perspective view of the horseshoe game showing a decal mounted around a stake and on top of the base.

Referring to FIG. 15 the base 2 comprises a decal 8 that mounts around a stake and extends a tad above the surface of base 2, the decal 8 has its own adhesive.

Figure 16:
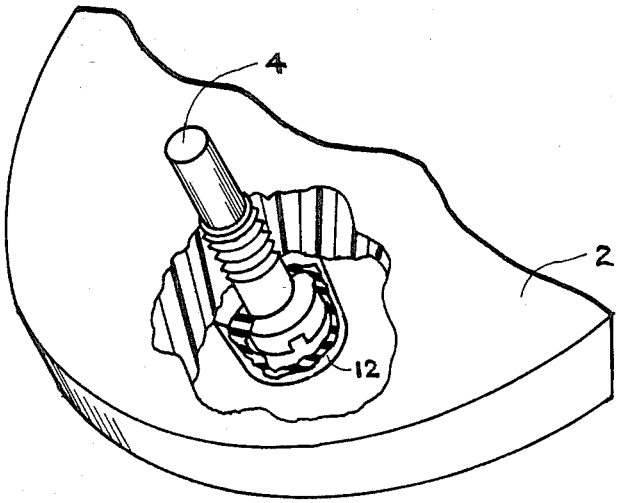
FIG. 16 is a partial perspective view of the horseshoe game showing stake and screw combination mounting rubber foot in place.

Referring to FIG. 16 the base 2 comprises four tapped holes like No. 6-32 thread. Only one stake and fastener 4 combination is shown with threads on it, also base 2 comprises of mounting four rubber feet 11 on the bottom surface, wherein 1 rubber foot is shown.

Figure 17:
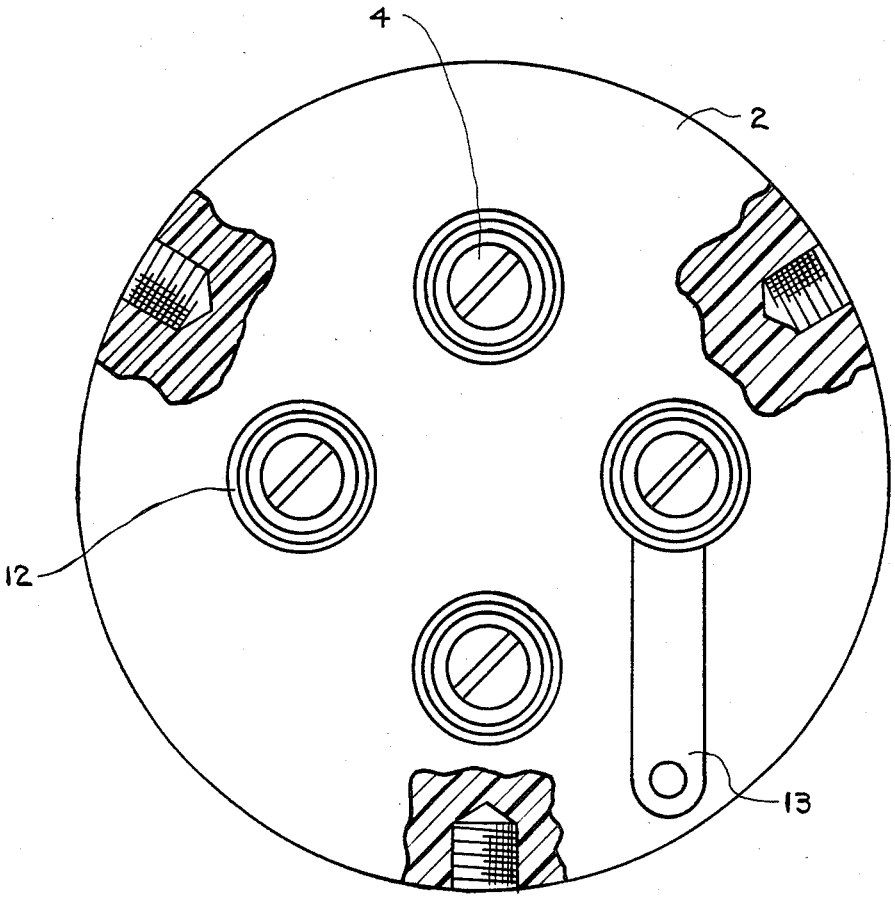
FIG. 17 is a bottom plan view thereof; showing stakes and screws combination mounting rubber feet, and in one incident shows mounting a hanger.

Referring to FIG. 17 the base 2 comprises three tapped holes located 120 degrees apart as shown, for the purpose of mounting the cover 1 onto base 2. Also shown are four slotted drives on the stake and fastener combination 4. The combination could have different kinds of drives, either phillips drive, hex socket drive, or etc. Also one fastener 4 is shown mounting hanger 13 for the purpose of hanging the unit on the wall or some other object.

It is believed the foregoing description conveys a good understanding of the objects and advantages of my invention; the appended claims have been drawn to cover all legitimate modifications and adaptations.

What is claimed is:

1. A horseshoe game apparatus comprising a substantially flat base, said base having spaced apart substantially parallel top and bottom surfaces and a plurality of threaded holes extending therethrough; said holes being substantially perpendicular with said top and bottom surfaces; a plurality of feet attached to said base, the number of said feet corresponding to the number of said holes in said base, each of said feet having a central bore extending therethrough; a plurality of stakes, each of said stakes having a head portion and a stem portion, said head portion being larger in diameter than said stem portion; thread means on said stem portion, said thread means extending from said head portion and along said stem portion a distance substantially equal to but not greater than the distance between said top and bottom surfaces of said base, each of said stem portions extending through a corresponding bore in said feet and a said hole in said base such that said thread means on said stem engage said threads in a said hole of said base thereby attaching said feet to said bottom surface; said stem portion further having a length greater than the distance between said top and bottom surfaces such that the ends thereof, remote from said head portion, will extend above said top surface; a plurality of U-shaped game pieces adatped to slide on said top surface, the distance between the legs of said game pieces being greater than the diameter of the extending ends of said stems; a transportation cover, said cover being attached to said base such that said U-shaped game pieces and extending ends of said stems are enclosed by said cover and base.

2. The game apparatus of claim 1 wherein there are four of said stems and four of said game pieces.

3. The apparatus of claim 1 wherein said head portion is countersunk into said support feet.

4. The apparatus of claim 1 wherein said stems have different colors and wherein each of said game pieces has a color corresponding thereto.

5. The apparatus of claim 1 wherein means is provided on a said base for hanging the apparatus on a wall.

6. The apparatus of claim 1, wherein said base top surface contains colored coded indicia for each of said stakes.

7. The apparatus of claim 6, wherein said indicia is selected from a group consisting of decals, rings, disks, and paint applied by a silkscreening process.

8. The apparatus of claim 6, wherein said rings and disks are to be flush within said top surface of said base and mounted in a detent or recess within said base.

* * * * *